United States Patent [19]

Hennecke

[11] 4,385,750

[45] May 31, 1983

[54] THERMAL CUTTING MACHINE

[75] Inventor: Franz Hennecke, Arnsberg, Fed. Rep. of Germany

[73] Assignee: I.P.U. Ltd., Nassau, The Bahamas

[21] Appl. No.: 266,980

[22] Filed: May 26, 1981

Related U.S. Application Data

[63] Continuation of Ser. No. 74,170, Sep. 10, 1979, abandoned.

[30] Foreign Application Priority Data

Sep. 11, 1978 [DE] Fed. Rep. of Germany ..... 2839449

[51] Int. Cl.[3] ..... B23K 7/02; B23K 7/10

[52] U.S. Cl. ..... 266/69; 266/50; 266/77

[58] Field of Search ..... 266/67, 68, 69, 53, 266/50, 77

[56] References Cited

U.S. PATENT DOCUMENTS

| | | | |
|---|---|---|---|
| 2,297,343 | 9/1942 | Young | 266/68 |
| 2,466,143 | 4/1949 | Young | 266/67 |
| 2,940,748 | 6/1960 | Sjostedt | 266/67 |
| 3,403,896 | 10/1968 | Mortellito et al. | 266/69 |
| 3,558,117 | 1/1971 | Hess | 266/50 |
| 3,901,491 | 8/1975 | Vertesi et al. | 266/50 |
| 3,929,324 | 12/1975 | Lotz et al. | 266/50 |
| 4,072,300 | 2/1978 | Pfeuffer et al. | 266/50 |

*Primary Examiner*—W. Stallard

*Attorney, Agent, or Firm*—Gifford, VanOphem, Sheridan & Sprinkle

[57] ABSTRACT

A thermal cutting machine for laterally cutting a displaceable strand of metal includes a car selectively engageable with the top surface of the strand, the car being adapted to travel on rails aligned with the direction of displacement of the strand. The car carries a movable cutter. In one preferred embodiment the load of the car on the rails at one end of the car is substantially constant whether or not the car is engaged with the top of the strand.

20 Claims, 6 Drawing Figures

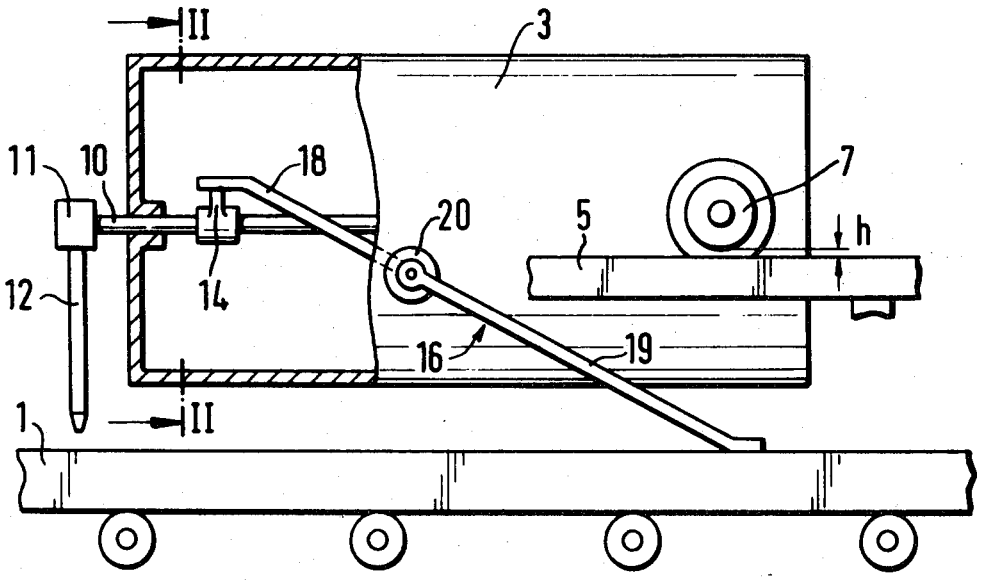

THERMAL CUTTING MACHINE

CROSS REFERENCE TO RELATED APPLICATIONS

This is a continuation, of application Ser. No. 74,170, filed Sept. 10, 1979, and now abandoned.

BACKGROUND OF THE INVENTION

I. Field of the Invention

This invention relates to a thermal cutting machine, comprising a car which is adapted to travel on rails disposed on either side of the strand for cutting and which bears a movable cutter and which is entrained by the strand by means of a bearing system adapted to be placed on to the top of the strand.

II. Description of the Prior Art

Thermal cutting machines of this type are coupled to the moving strand before the cutting operation is started. Clamping systems were originally used for this purpose, but they proved disadvantageous and have been replaced by the bearing system mentioned above. In a thermal cutting machine disclosed, for example, in Austrian patent specification No. 330 972 and of the kind referred to hereinabove, externally controlled hydraulic drives and expensive guide means are required on the car in conjunction with the bearing system, and this makes the cutting machine complicated, expensive to manufacture and maintenance-intensive.

SUMMARY OF THE PRESENT INVENTION

The object of the invention is to provide an improved and, in particular, simplified thermal cutting machine of the kind referred to hereinabove.

According to the invention, this problem is solved by the features disclosed in claim 1, and advantageous aspects are disclosed in the claims depending therefrom.

The main feature of the invention lies in the simplified bearing system which dispenses with expensive hydraulic or similar drives and which operates automatically or at least semi-automatically by coupling to an external drive mechanism, which is provided in any case.

The external drive mechanism can, for example, be the burner drive by means of which the burner moves with respect to the car, e.g. is pivoted about an axis.

By way of example, the bearing system can be actuated by means of a control cam or via a simple lever or lever frame.

In this way it is possible, by means of the burner movement, to initiate the machine drive by means of the strand. As soon as the burner has reached a predetermined position with respect to the strand for cutting, it automatically actuates the bearing system and the machine is entrained by the strand as the process continues. As soon as the parting cut has been made, the bearing system can be automatically put out of operation again. This automatic initiation of the bearing system can be carried out even with alternate cutting from left to right and right to left, as a result of the appropriate configuration of the control element. This avoids a long return travel by the burner and also reduces the synchronization path of the strand and machine.

Advantageously the bearing system can comprise elements which provide an additional non-positive and/or positive lateral bearing contact with the strand. This avoids the risk of any tilting with very narrow cutting machines.

The car is also preferably provided with profiled wheels which have lateral guidance properties with respect to the rails. The bearing system is advantageously so designed that it supports the car only at one end and relieves it of load, without lifting, or with only slight lifting, to such an extent that the supporting force required for entrainment by the strand is obtained. As soon as the bearing force exceeds the normal axle load, the height by which the wheels are lifted with respect to the rails is automatically so limited that the boundary of their profile is still in lateral engagement (in this connection see FIG. 1).

BRIEF DESCRIPTION OF THE DRAWING

Some preferred exemplified embodiments of the invention are explained in detail hereinafter with reference to a drawing wherein.

DETAILED DESCRIPTION OF THE PREFERRED EMBODIMENT OF THE PRESENT INVENTION

Figure 1:
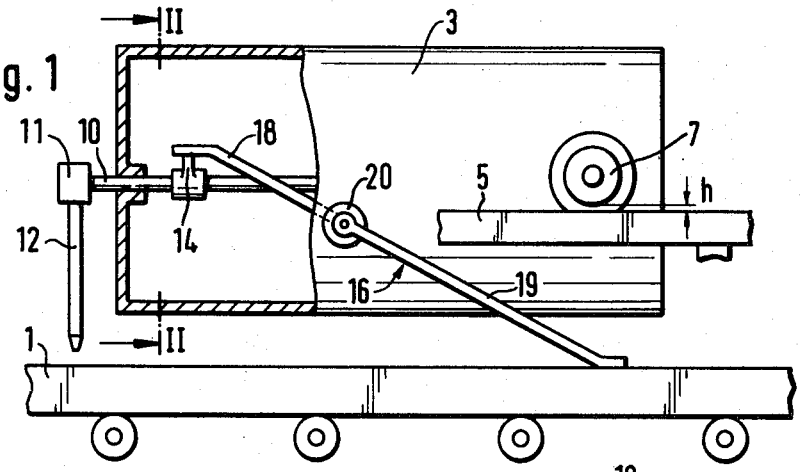
FIG. 1 is a partial side elevation of a first preferred embodiment of a thermal cutting machine according to the invention.
Figure 2:
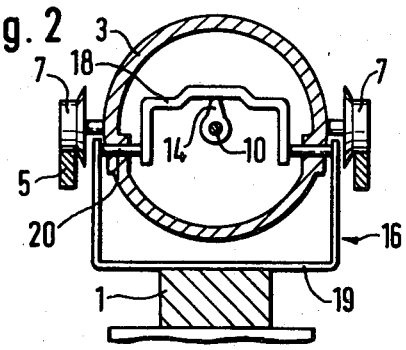
FIG. 2 is a cross-section taken along the line II—II in FIG. 1.

The preferred embodiment of a thermal cutting machine according to the present invention is shown in FIGS. 1 and 2 and is used for cutting a strand 1 into billets or ingots, and is driven non-positively and synchronously during the cutting operation, by the strand 1 as it moves in the longitudinal direction. The machine is in the form of a car running on rails 5 by means of running and guide wheels 7, which are constructed as profiled wheels, the car having a hollow housing 3, on a longitudinal axis of which a shaft 10 is mounted rotatably. The shaft 10 extends outwardly of one end of the car. A burner holder 11 with a burner 12 is fixed on the free end of the shaft 10. Burner 12 is movable with respect to the strand 1 by means of the shaft 10 during the cutting operation, so that the cut can be carried out from left to right or from right to left (as the strand is viewed in FIG. 2).

A lifting cam 14 fixed on the shaft 10 is operatively connected to a lever frame 16, the central portion of which is mounted pivotally with respect to the housing 3 in a bearing 20. Frame 16 is divided into an inner portion 18 bearing against the cam 14, and an outer portion 19 used to bear on the strand 1.

When the burner 12 reaches the start position with respect to the strand 1 when the machine is in operation, the shaft 10 with the cam 14 is rotated to turn the frame 16 about its bearing 20 and bring the car into contact with the strand 1. The bearing force at one end of the car causes the entire machine to be driven by the strand 1. The supporting force at the outer frame section 19 is so dimensioned, as a result of the configuration of the cam 14, that an adequate entraining force is produced but the associated end of the car is not lifted at all, or else by only a small amount having the reference h in FIG. 1. This ensures that the lateral guidance provided by the profiled wheels 7 with respect to the rails 5 is fully maintained.

As will be seen from FIG. 2, the cam 14 is of symmetrical construction so that the same lifting properties are obtained in either direction of rotation of the shaft 10, i.e. if the cut is from left to right or from right to left.

Figure 3:
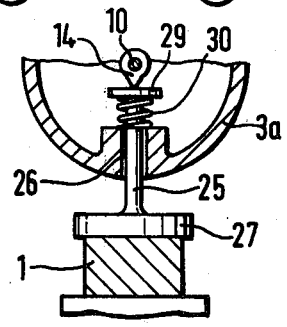
FIG. 3 is a similar partial section to FIG. 2 through another preferred embodiment.

In another preferred embodiment shown in fragmentary form in FIG. 3, a lever frame at one end of the machine car housing 3*a* is replaced by a plunger 25 which is vertically extensible in a guide 26 at the bottom, and which has a contact plate 27 bearing on the strand 1. In this case the cam 14 acts on a pressure plate 29 fixed to the free end of the plunger 25 and a return spring 30 returns the plunger 25 to its raised inoperative position after the cam has rotated.

In this exemplified embodiment too, the travel of the plunger 25 is limited to such an extent that the guidance of the wheels 7 with respect to the rails (not shown) is fully maintained when the car is in bearing contact.

Figure 4:
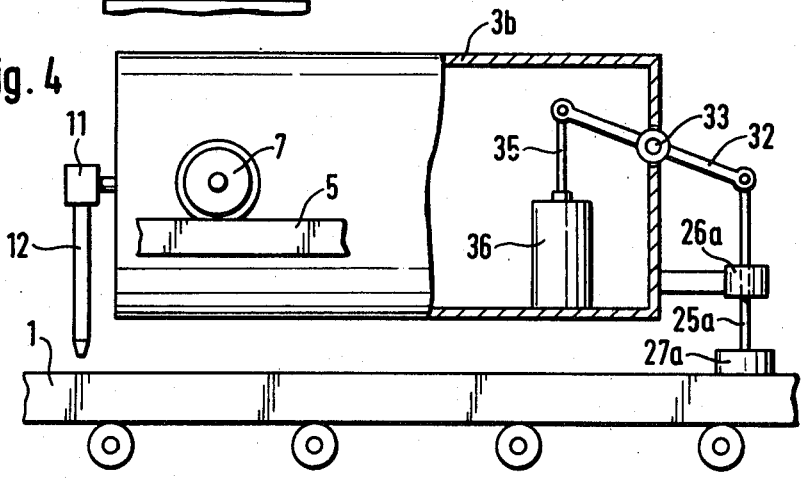
FIG. 4 is a side elevation in partial section through another preferred embodiment.

In another preferred embodiment shown in FIG. 4, the supporting system for the machine end remote from the burner 12 is a pnuematic cylinder 36. The machine housing in this case has the reference 3*b*. The bearing force can be metered very accurately with a pneumatic cylinder of this kind and it is possible to completely avoid the wheels 7 being lifted away from the rails 5. The bearing force is so adjusted as to give exactly the required driving force with respect to the strand 1. In the embodiment shown in FIG. 4, the plunger 25*a* is fully outside the housing 3*b* and is guided by an external guide 26*a*. A lever 32 is mounted pivotally on a pivot 33 in the associated end wall of the housing 3*b* and connects a piston rod 35 of the pneumatic cylinder 36 to the top end of the plunger 25*a*.

As an alternative to the embodiments described hereinbefore, the bearing system can be driven by an electric motor or hydraulically.

In every case there is no need for a separate control for the bearing system, which is automatically started and stopped by the burner drive. Alternatively, it is possible to control the system by the propulsion unit or the like.

Figure 5:
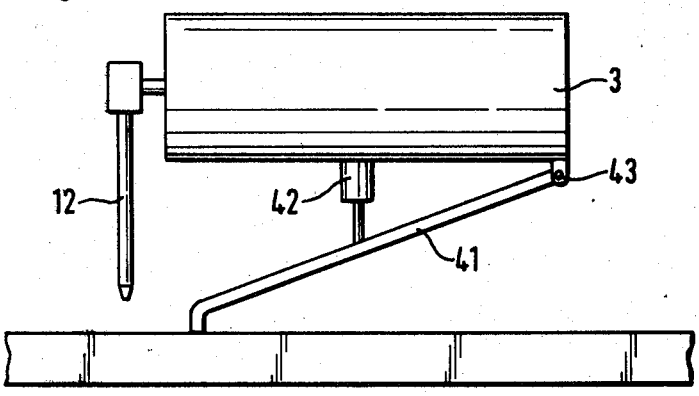
FIG. 5 is a side elevation of another preferred embodiment.

As shown in FIG. 5, an embodiment is possible which combines elements of the embodiment according to FIG. 1 and of the embodiment according to FIG. 4. A clamping lever 41 is mounted pivotally on the housing 3 at the rear thereof, at 43. In other cases the lever 41 can be pivoted to the front of the housing 3. The lever 41 is actuated by a cylinder 42 fixed in the housing 3 or mounted laterally on the housing 3 depending upon the configuration of the latter.

Figure 6:
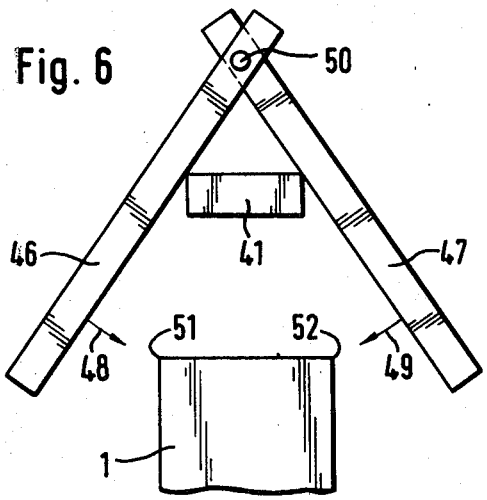
FIG. 6 is a top elevation of another preferred embodiment.

As shown diagrammatically in FIG. 6, sensing levers 46, 47 can be provided to control the cutting speed of the burner 12 and as shown by the arrows 48 and 49 tend to swing towards one another and bear against the lever 41. When the latter is lowered by actuation of the cylinder 42 for clamping purposes, the sensing levers 46 and 47 swing towards one another about the common pivot 50 and come to bear against the strand 1 at the corners 51 and 52. By means of cams (not shown) their position controls electrical switches and hence the speed of the burner in the initial phase, its actual cutting speed, and the speed of the burner in the end phase of the cutting operation. Alternatively, the levers 46, 47 can be pivoted about separate axes (not shown) by the lever 41, in which case the control cams and associated limit switches will be arranged accordingly.

What is claimed is:

1. A thermal cutting machine for laterally cutting a strand of metal which is displaced in a first longitudinal direction by a first means for displacing the strand, comprising:

a car which is adapted to travel on rails aligned in said first direction, a movable cutter carried by said car, and second selectively engageable means for fixedly positioning said car with respect to said strand by engaging the top surface of the strand, and third means for automatically selectively engaging said second means.

2. The invention as defined in claim 1 wherein said third means comprises a fourth means for moving said cutter relative to said car.

3. A machine according to claim 2 wherein said third means further comprises:

fifth means responsive to said fourth means for transforming movement of said cutter into a motive force for said third means; and sixth means responsive to said fifth means for transforming the response of said fifth means into a motive force for said second means.

4. A machine according to claim 3 wherein said sixth means comprises a control valve for a jack cylinder.

5. A machine according to claim 3 wherein said sixth means is a mechanical transmission means for mechanically engaging said second means.

6. A machine according to claim 5 wherein said mechanical transmission means comprises a lever.

7. A machine according to claim 6 wherein said lever is pivotally secured near its center to said car.

8. A machine according to claim 1 wherein said second means is mounted to the car so that engagement with the strand occurs at one end of the car, whereby the load of the car upon the rails at the opposite end of the car remains substantially constant when in bearing contact in the operative state and when the bearing system is in the unloaded inoperative state.

9. A machine according to claim 3 wherein said fourth means comprises a rotatable shaft secured to said burner, and wherein said fifth means comprises a cam secured to said shaft.

10. A machine according to claim 9 wherein said control cam is so shaped as to be operative in the same way in opposite directions of rotation of the shaft.

11. A machine according to claim 1 wherein said fifth means limits the engagement of said second means to a predetermined force.

12. A machine according to claim 1 and further comprising fourth means for automatically disengaging said second means when said third means is inoperative.

13. A machine according to claim 12 wherein said fourth means comprises a spring.

14. A machine according to claim 12 wherein said fourth means is activated by gravity.

15. A machine according to claim 1 wherein said second means also comprises means for contacting the lateral edges of the strand.

16. A machine according to claim 1 characterized in that said car includes wheels having means for laterally guiding the wheels with respect to the rails.

17. A machine according to claim 1 wherein said second means comprises a clamp lever and a piston-cylinder arrangement fixed with respect to the housing and operatively connected to said lever.

18. A machine according to claim 17 wherein said lever is pivotally mounted at one end of said housing.

19. A machine according to claim 18 and further comprising two sensing levers pivotally secured to the car above said clamping lever whereby the angular position between said levers is variable as the free end of said clamping lever is pivoted intermediate the free ends of said sensing levers and the strand and means for controlling the cutting speed of the burner in response to the angular position of said sensing levers.

20. A machine according to claim 19 wherein said sensing levers pivot about a common axis.

* * * * *